United States Patent [19]

Bisbing

[11] Patent Number: 5,064,228

[45] Date of Patent: Nov. 12, 1991

[54] REMOTE LATCH MECHANISM

[75] Inventor: Robert H. Bisbing, Delaware County, Pa.

[73] Assignee: South Co. Inc., Concordville, Pa.

[21] Appl. No.: 413,969

[22] Filed: Sep. 28, 1989

Related U.S. Application Data

[63] Continuation-in-part of Ser. No. 149,571, Jan. 28, 1988, Pat. No. 4,880,261.

[51] Int. Cl.[5] ..... E05C 9/08

[52] U.S. Cl. ..... 292/54; 292/218; 292/DIG. 31; 292/DIG. 60; 292/336.3

[58] Field of Search ..... 292/113, 247, 217, 218, 292/200, DIG. 31, DIG. 60, 36, 54, 336.3

[56] References Cited

U.S. PATENT DOCUMENTS

| | | | |
|---|---|---|---|
| 595,425 | 12/1897 | Adams | 292/240 X |
| 982,087 | 1/1911 | O'Connor | 292/218 |
| 1,919,328 | 7/1933 | Hansen | 292/218 |
| 2,506,553 | 5/1950 | Slaughter, Jr. et al. | 292/240 |
| 2,548,681 | 4/1951 | Oswald | 292/240 |
| 3,224,066 | 12/1965 | Overland | 292/240 X |
| 4,038,718 | 8/1977 | Reilhac et al. | 292/DIG. 31 X |
| 4,134,281 | 1/1979 | Pelcin | 292/218 X |
| 4,693,503 | 9/1987 | Bisbing | 292/DIG. 31 X |

*Primary Examiner*—Richard E. Moore

[57] ABSTRACT

A remote latching mechanism comprises connecting member, preferably a cylindrical rod, an actutor assembly for rotating the connecting member about its longitudinal axis, and a latch assembly connected to the connecting member for movement between latched and unlatched conditions in response to the rotation of the connecting member. The latch assembly comprises a crank, at least one link member having over-center action, a pawl support and a pawl, all inter-connected so that upon rotation of the crank, the pawl is pivoted and slid relative to a latch housing between latched and unlatched positions. The actuator assembly comprises an actuator fixedly connected to the connecting member. In one embodiment, the actuator comprises a pivotable handle. In the other embodiments, the actuator comprises a substantially cylindrical member to which torque is applied by a tool or a lever to rotate the connecting member.

14 Claims, 5 Drawing Sheets

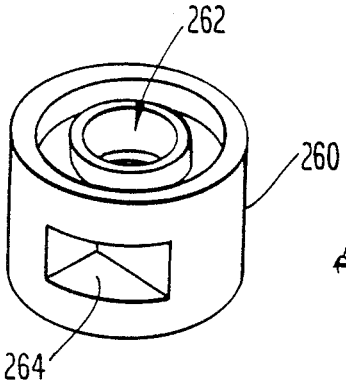
Fig. 13A
Fig. 13
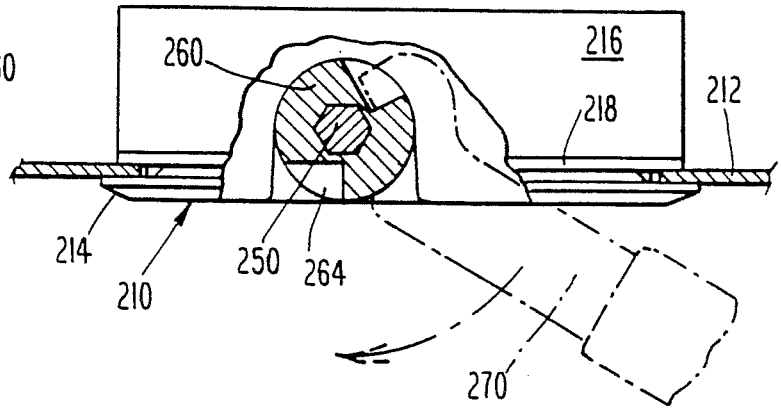
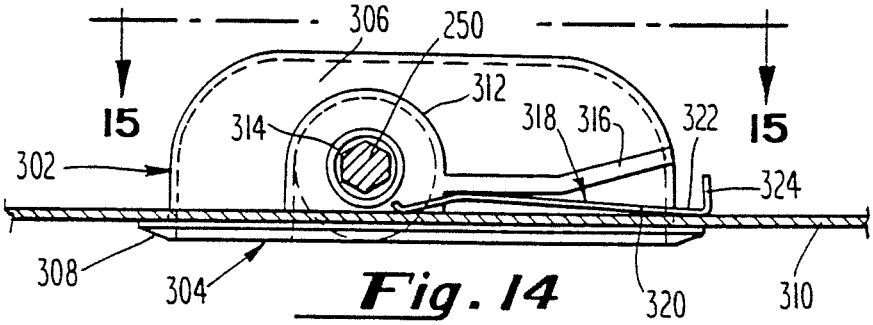
Fig. 14
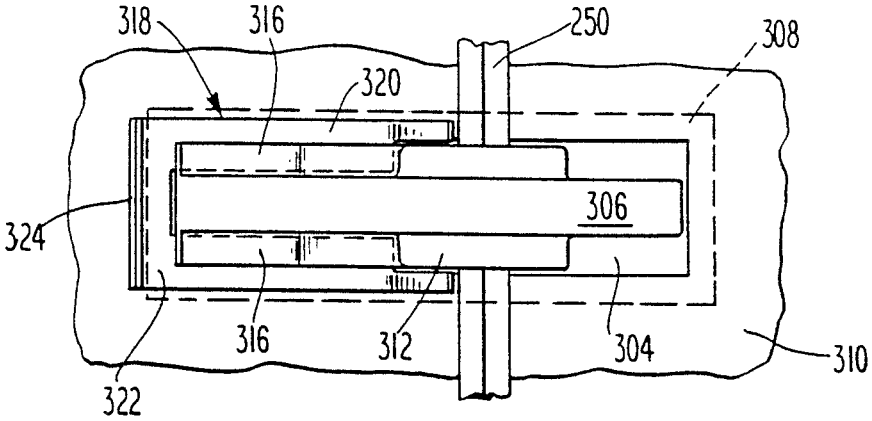
Fig. 15
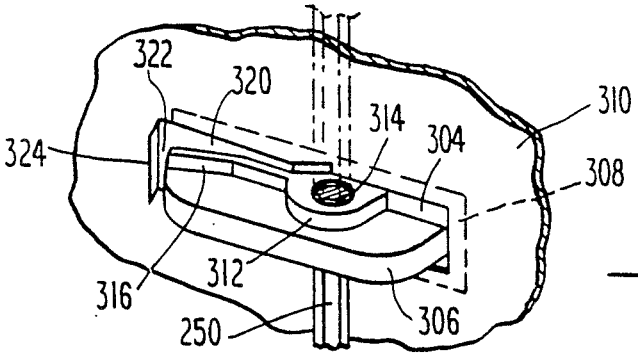
Fig. 16

REMOTE LATCH MECHANISM

CROSS-REFERENCE TO RELATED U.S. APPLICATIONS

This application is a continuation-in-part of U.S. Pat. application Ser. No. 149,571, filed Jan. 28, 1988, for REMOTE LATCH MECHANISM, now U.S. Pat. No. 4,880,261, issued Nov. 14, 1989.

BACKGROUND OF THE INVENTION

This invention relates to the field of latching mechanisms, and more particularly to the field of remote latching mechanisms. A remote latching mechanism, as the term is used herein, is a latching mechanism in which the latching action of the mechanism occurs at a location remote from the latch actuator part of the mechanism.

Many types of remote latching mechanisms are known and used in the art. One of the most common types is the garage door mechanism located inside the garage door, wherein a centrally located latch actuator assembly, which usually consists of a handle protruding from the outside of the door and connected by an axle to the mechanism on the inside of the door, is connected in an offset fashion to one end of a pair of latching bars with each bar traversing the inside of the garage door horizontally and in opposite directions. The other end of each of the latching bars terminates just short of the inside edge of the respective sides of the garage door, where it is usually retained in a keeper, when the latching mechanism is in an open position.

To latch the mechanism, the handle is rotated which causes the latching bars or rods to extend laterally into a detent or cutout provided on a frame which usually is located on the inside of the garage wall and next to each of the respective sides of the garage door. Another type of remote latch mechanism is disclosed in co-pending U.S. Pat. application Ser. No. 100,623, filed Sept. 24, 1987, now U.S. Pat. No. 4,893,849, issued Jan. 16, 1990 for REMOTE LATCHING MECHANISM, which disclosure is incorporated herein by reference. As is discussed in fuller detail in the abovereferenced application, distinction can be made between compression type remote latching mechanisms, and non-compression type remote latching mechanisms, with the compression type remote latching mechanism typically providing greater security and precision in the latched position.

SUMMARY OF THE INVENTION

The present invention is directed towards a remote latching mechanism which provides a high degree of precision and security, whether used as a compression type remote latching mechanism or, alternatively, used as a non-compression type remote latching system. The remote latching mechanism is particularly suited for use in securing closure members to a frame, such as cabinets or like structures.

The present invention comprises an actuator assembly or a handle assembly, with a connecting means, preferably a bar or rod, connected to at least one latch assembly. In one embodiment the handle assembly comprises essentially a cup adapted to be affixed within an aperture in a door or the like and a handle pivotally mounted to the cup for actuation from the outside of the door. The connecting means is preferably a continuous longitudinal rod which is disposed vertically on the inside of the door and is affixed to the handle for rotational movement in response to the pivoting movement of the handle.

In lieu of the handle assembly (or in addition thereto) alternate embodiments of the actuating assembly are provided. One such embodiment comprises a cup adapted to be affixed within an aperture in a door or the like by means of a spring clip or by means of a bracket and screws. Disposed within the cup for rotational movement is an actuator hub which is affixed to the connecting means, whereby upon application of torque to the actuator hub the connecting means is rotated to actuate the latch assembly.

In another embodiment, the actuating assembly comprises a lever affixed to a terminal end of the connecting means on the outside of the cabinet. Pivoting the lever transmits rotational movement to the connecting rod, which in turn actuates the latch assembly.

The latch assembly comprises a housing adapted to be affixed to the inside of the door, a crank, a pair of link members connected to the crank, a pawl support member connected to the links, and a pawl affixed to the support member. The crank is in operable engagement with the connecting rod, whereby upon rotation of the rod, the pawl is pivoted and slid between latched and unlatched positions. The link members, forming the operative connection between the crank and the pawl, comprise over-center members to provide positive latching action.

It is a feature of the present invention that the actuator assembly actuates the latch assembly through the rotation of the connecting means about its longitudinal axis. In the preferred embodiments, this feature allows for the use of a continuous rod as the connecting means for a plurality of latch assemblies operable by actuation of a single actuator assembly. It should be noted, however, that a non-continuous rod or other type of connecting means rather than a continuous connecting means could be used without departing from the scope of the present invention.

Accordingly, it is an object of the present invention to provide a remote latching mechanism that can be used as either a compression or non-compression remote latching mechanism.

It is a further object of the present invention to provide a remote latch mechanism wherein the latch assembly is actuated through an elongate connecting means which rotates about its longitudinal axis.

It is a further object of the present invention to provide a remote latching mechanism wherein a plurality of latch assemblies may depend from a connecting rod and are actuated by a single actuating means.

It is still another object of the invention to provide a remote latching mechanism having positive over-center latching action.

It is yet another object of the invention to provide a remote latching mechanism which is economical to manufacture and easy to install.

It is a further object of this invention to provide a secure remote latching mechanism which has an aesthetically pleasing appearance when viewed from the outside.

It is yet another object of the invention to accomplish the above objects by providing a remote latching mechanism having a longitudinal connecting means, actuating means for rotating the connecting means about its longitudinal axis, and at least one latch mechanism operably engaged with the connecting means for actuation of a latching pawl in response to rotational movement of the connecting means.

These and other objects of the invention will become apparent to one skilled in the art upon a further reading of the specification, including the detailed description of the embodiments with reference to the drawings and the appended claims.

BRIEF DESCRIPTION OF THE DRAWINGS

FIG. 13 is a top plan view, partially sectioned, of the actuator assembly of FIGS. 9–12, particularly illustrating the application of torque to the actuator hub which, in this case, is of a tamper-resistant design;

FIG. 13A is a perspective view of an actuator hub usable in the embodiments of FIGS. 9–16, particularly illustrating the tamper-resistant construction of the hub;

FIG. 14 is a top plan view of the actuator assembly, particularly illustrating the structure of the cup for attachment by means of a spring clip;

FIG. 15 is a rear view of the actuator assembly, as seen along line 15—15 of FIG. 14;

FIG. 16 is a perspective view from the rear of the actuator assembly of FIG. 15;

DETAILED DESCRIPTION OF THE EMBODIMENTS

Figure 1:
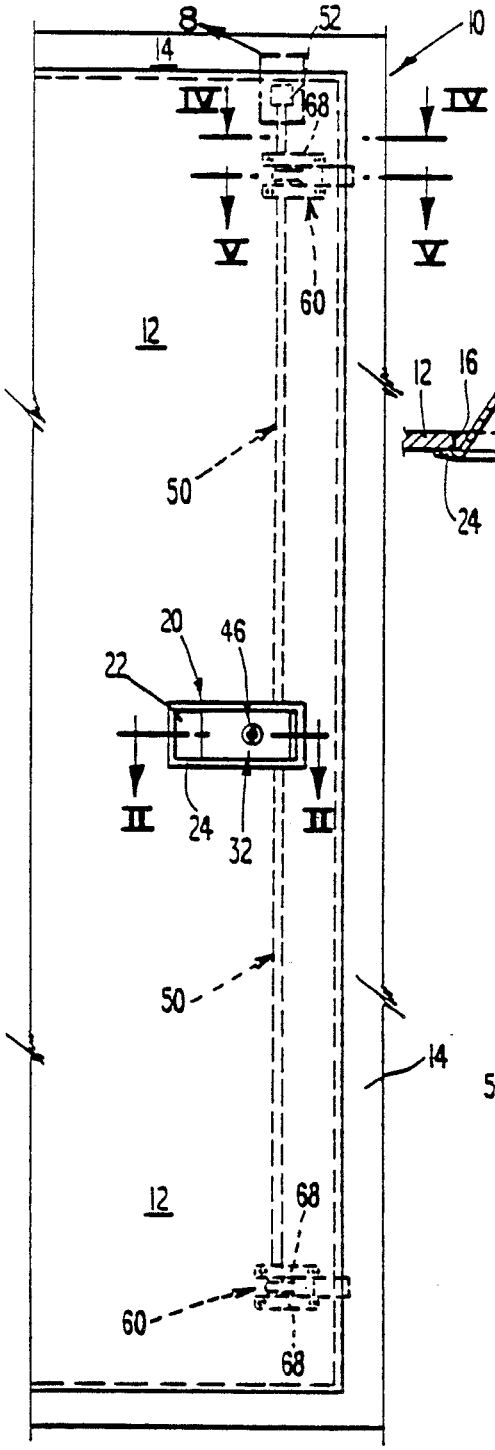
FIG. 1 is a front elevational view of one embodiment of the present invention, as applied to a cabinet or the like, comprising a handle assembly, connecting rod, and two latch assemblies.

With reference first being made to FIG. 1, one embodiment of the remote latching mechanism in accordance with the present invention is illustrated therein installed on a typical cabinet structure 10, having an openable door 12 and a stationary frame 14. In the particular embodiment shown in FIG. 1, the remote latching mechanism comprises a handle assembly 20, a single continuous connecting rod 50 connected to handle assembly 20 and vertically disposed on the inside of door 12, and two latch assemblies 60 connected to the connecting rod at spaced locations along the rod 50 from the handle assembly 20. In the view shown in FIG. 1, handle assembly 20 is in the closed position and latch assemblies 50 are in the latched position, whereby the door 12 is securely retained against frame 14.

Figure 2:
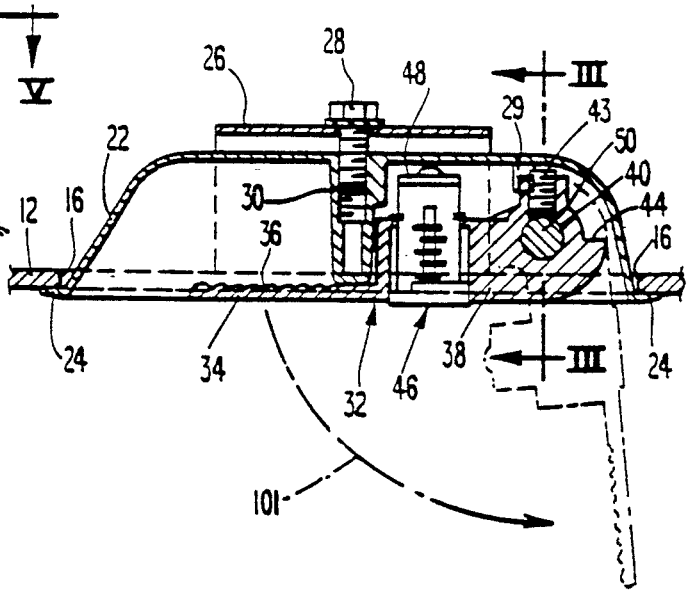
FIG. 2 is a sectional view of the handle assembly along line 2—2 of FIG. 1, with the handle in an unlatched position being shown in phantom.
Figure 3:
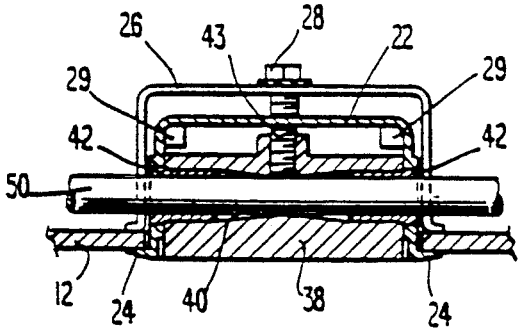
FIG. 3 is a sectional view of the handle assembly taken along line 3—3 of FIG. 2.

With reference now being made to FIGS. 1–3, handle assembly 20 comprises a bath-tub shaped cup member 22 having outwardly-turned edges to form a peripheral flange 24 on the outside of the cup 22. The cup 22 is adapted for being inserted within a suitable aperture 16 in door 12, whereby peripheral flange 24 is disposed substantially flush with the outer surface of door 12 (See FIGS. 2–3). Cup 22 is held within aperture 16 of door 12 by bracket 26 which, as seen in FIG. 3, is a substantially U-shaped member and is adapted to engage the inside surface of the door 12.

As seen in FIGS. 2 and 3, bracket 26 is secured to cup 22 by a screw 28 or other suitable fastener which traverses bracket 26 and is received within boss 30 of cup 22. In this arrangement, which is perhaps best seen in FIG. 3, door 12 is clamped between bracket 26 and peripheral flange 24 of cup 22, whereby cup 22 is securely held within aperture 16 of the door. In other words, door 12 is held in sandwich relation between bracket 26 and peripheral flange 24.

Pivotally connected to cup 22 of handle assembly 20 is handle 32 which, as seen in FIG. 2, is an irregular shaped member having a substantially flat section 34 which terminates at a location intermediate boss 30 of frame 22 and the end wall of cup 22, such that a space is created within cup 22 to accommodate the fingers of the user of the latch mechanism. To facilitate the pivoting of handle 32, the finger-engageable surface of flat section 34 may be provided with serrations 36, as seen in FIG. 2.

Adjacent flat section 34, handle 32 is provided with a substantially thickened section 38. Section 38 of handle 32 is pivotally connected to cup 22 for pivoting of handle 32 relative to the cup. Section 38 also forms the connection of handle 32 to connecting rod 50 for actuation of the latch assemblies 60, all of which will be described more fully below. As best seen in FIG. 3, section 38 of handle 32 is provided with a transverse bore 40 which has a venturi-like shape when viewed along its longitudinal axis. Disposed within bore 40 at the ends thereof are a pair of bushing members 42 which are secured within cup 22, whereby bushing members 42 comprise means for pivotally connecting handle 32 to cup 22.

Thickened section 38 is also provided with a peripheral abutment 44 which, when handle 32 is pivoted to its open position illustrated in fanthom in FIG. 2, abuts against stop members 29 of cup 22 (see FIG. 3) to limit the pivotal movement of handle 32.

If desired, handle 32 may also be provided with an integral locking means, such as lock cylinder 46, as shown in FIG. 2. Lock cylinder 46 is of known construction and operates in a known manner. To lock the handle 32 in position, a rotatable locking tab 48 is provided which, when lock cylinder 46 is actuated, will rotate to engage boss 30 to prevent the pivoting of handle 32 relative to cup 22 and thus, as explained below, the actuation of latching mechanisms 60.

Connecting rod 50, in the embodiment illustrated in the FIGS., is a continuous, elongate rod having a circular cross-sectional shape. Although a connecting rod of such configuration is preferred for reasons of strength, economy of manufacture and ease of assembly, it is to be understood that polygonal rods or flat bars are also suitable, if desired. Furthermore, although the connecting rod 50 shown in the FIGS. comprises a single continuous member engaging handle assembly 20 and both latching assemblies 60, it is to be understood that other configurations may be used, if desired, so long as at connecting rod 50 engages at least one actuator assembly and at least one latching assembly.

With reference to FIGS. 2 and 3, connecting rod 50 is disposed within bore 40 of handle 32 and in close-fit relation to bushing members 42. Set screw 43 in thickened section 38 of handle 32 maintains the connecting rod 50 within bore 40, whereby connecting rod 50 rotates about its cross-sectional center in response to the pivoting of handle 32. As seen in FIG. 2, connecting rod 50 comprises the pivotal axis for the pivoting of handle 32 relative to cup 22.

Figure 8:
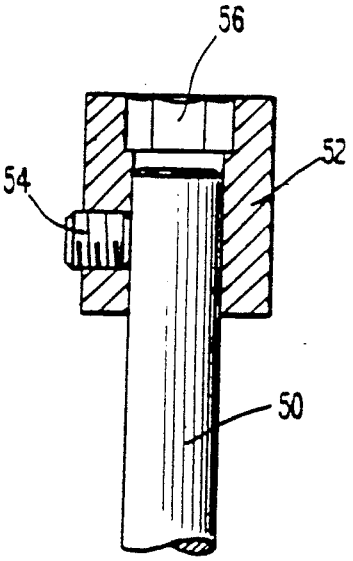
FIG. 8 is an enlarged sectional view of an alternate actuation means for actuating the latch assemblies of FIG. 1, which may be used in lieu of or in addition to the handle assembly.
Figure 6:
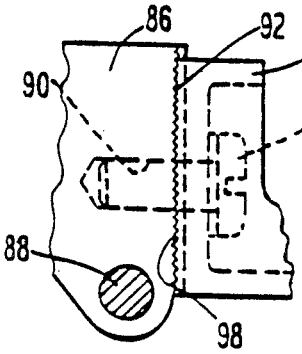
FIG. 6 is an enlarged, isolated view of the connection between the pawl and pawl support illustrating the adjustability feature of the pawl.

An alternative means for rotating connecting rod 50 is shown in FIG. 8 and comprises a socket member 52 which is adapted to fit over a terminal end of rod 50. Socket member 52 is also provided with a set screw 54 which engages rod 50 whereby rod 50 is rotatably movable in response to the application of torque to socket member 52. As seen in FIG. 8, socket member 52 is provided with a suitably shaped recess 56 therein which is adapted to receive a suitably shaped tool, such as a hex key, for the application of torque to the socket member. Socket member 52 is entirely optional, in accordance with the desires of the user of the present invention, and may be used in lieu of or in addition to the handle assembly 20 as means for actuating latch assemblies 60. If socket member 52 is used, a suitable access will need to be provided in the cabinet 10 or other structure to which the invention is applied.

With reference now being made to FIGS. 4–7, the latch assembly 60 of the present invention will now be described. Latch assembly 60, as seen in the FIGS., comprises a housing 62 having spaced-apart side walls 64 and a top wall 66. The lower edges of side walls 64 are turned outwardly to form mounting flanges 68 (see FIG. 1) which flanges 68 comprise means for facilitating the mounting of housing 62 to the inside surface of door 12, such as by screws 70 or like fastening means.

Disposed within housing 62 between spaced-apart side walls 64 is a crank member 72 which, as seen in the FIGS., is provided with an aperture 74 therein into which is disposed sleeve 76. As seen in the FIGS., sleeve 76 is adapted to receive connecting rod 50 therein in close-fit relation and sleeve 76 is also in close-fit relation to crank 72. Crank 72 is also provided with a set screw 78 which is positioned to engage sleeve 76 and connecting rod 50. In this arrangement, crank 72 rotates within housing 62 in response to rotational movement of connecting rod 50. (See FIGS. 5 and 5A.) Aperture 63 in top wall 66 of housing 62 facilitates the loosening and tightening of set screw 78.

A pair of link members 80 are affixed to crank 72 by transverse pin 82. Link members 80, as seen in the FIGS., are substantially "hourglass" or "figure-eight" shaped members and are movable in response to rotation of crank 72. As will be described more fully below, link members 80 comprise over-center members during operation of latch assembly 60.

Pivotally connected to link members 80 by transverse pin 84 is a pawl support 86. As seen in the FIGS., pawl support 86 is substantially triangular in shape and is provided with a transverse guide pin 88, the significance of which is described below. The right-hand edge (as viewed in the FIGS.) of pawl support 86 is provided with at least one, and preferably two tapped apertures 90, and is also preferably provided with small serrations 92 on the surface thereof. (See FIGS. 4 and 6.) Tapped apertures 90 facilitate the connection of pawl 94 to pawl support 86, such as by screw 96, or like fastener.

Figure 4:
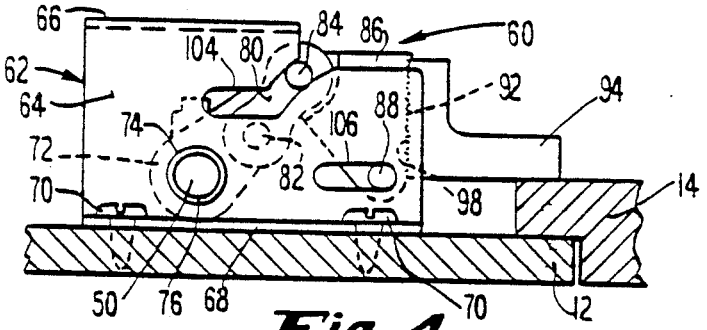
FIG. 4 is an elevational, partly sectioned, view of the latch assembly taken along line 4—4 of FIG. 1.
Figure 5:
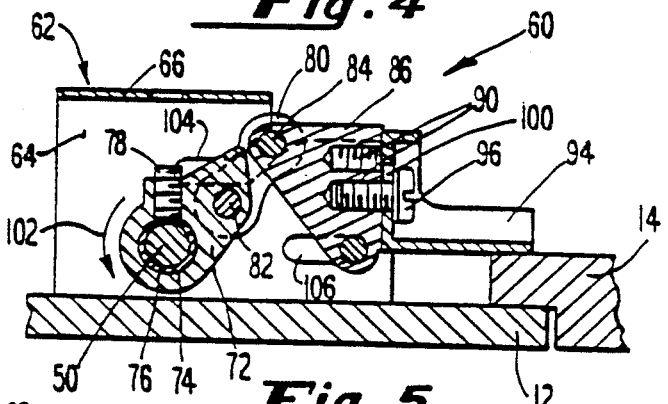
FIG. 5 is a sectional view of the latch assembly as seen along line 5—5 of FIG. 1, showing the latch assembly in a latched position.
Figure 7:
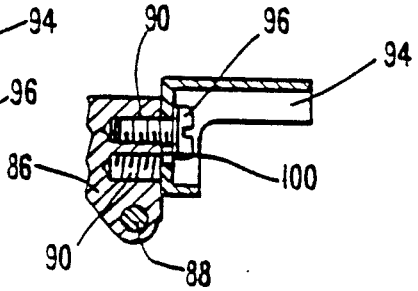
FIG. 7 is a sectional view of the pawl and pawl support, similar to FIG. 6, with the orientation of the pawl being reversed to accommodate for greater door and frame dimensions.

Pawl 94, as seen in FIGS. 4, 5 and 7, is a substantially L-shaped member having a short leg affixed to the pawl support 86 whereby the long leg of pawl 94 extends beyond housing 62. To facilitate the adjustability of pawl 94 so as to accommodate for variable door and frame dimensions and for different compression loads (such as when a gasket is employed between the door and frame of the structure), serrations 98 are provided on the short leg of pawl 94. Serrations 98 mate with serrations 92 of pawl support 86 (see FIG. 6) to provide for incremental vertical adjustment of pawl 94 relative to pawl support 86. A slotted aperture 100 in pawl 94, through which screw 96 is disposed, further facilitates the adjustment of pawl 94 relative to pawl support 86. As seen in FIG. 7, pawl 94 can be removed and reversed to accommodate for large door/gasket/frame dimensions, in which case the other tapped aperture 90 may be used to secure pawl 94 to pawl support 86.

Although in the preferred embodiment, the pawl and pawl support are two separate members and are provided with serrations on their mating surfaces, it is to be understood that the pawl and pawl support can also be formed together in a one-piece member, and need not be two separate pieces for the proper functioning of the invention. In addition, it is to be understood that if a separate pawl and pawl support is used, the mating surfaces need not be serrated, but may be of a smooth texture.

Figure 5A:
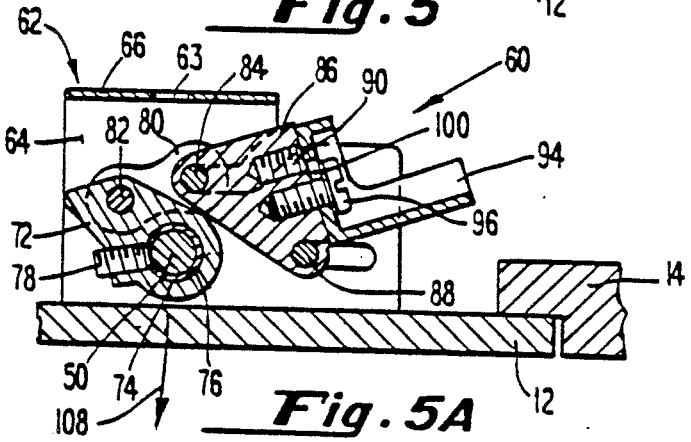
FIG. 5A is a sectional view, similar to FIG. 5, showing the latch assembly in the unlatched position.

The operation of the present invention will now be fully described with particular reference to FIGS. 2, 5 and 5A. When the remote latching mechanism of the present invention is the latched or closed position, handle 32 is in the position shown in solid lines in FIG. 2 and pawl 94 is secured against frame 14, as seen in FIG. 5, whereby door 12 is held firmly closed. To open door 12, the fingers of the user are inserted into the space in cup 22 of handle assembly 20 to engage serrated surface 36 of handle 32. A simple lifting force is then exerted by the user, causing handle 32 to pivot, in the direction of arrow 101, into the open position illustrated in broken lines in FIG. 2.

Upon the pivoting of handle 32, connecting rod 50 will rotate counterclockwise about its longitudinal axis via its connection with handle 32 by set screw 43. The counterclockwise rotation of rod 50 will cause crank 72 to rotate counterclockwise in the direction of arrow 102, as seen in FIG. 5, via the set screw 78 and sleeve 76 connection to rod 50. The rotation of crank 72, via pivot pin 82, will cause link members 80 to first pivot about transverse pin 84, and then to move leftwardly as crank 72 continues to rotate. It is during the initial pivoting movement of links 80 that transverse pin 82 crosses the on-center position between rod 50 and pin 84. The movement of pin 84 is guided by a pair of curved slots 104 in side walls 64 of housing 62. (See FIG. 4.)

Pawl support 86, being connected to link members 80 by pin 84, will undergo a sliding and pivoting motion as link members 80 and crank 72 are moved. The movement of pawl support 86 is guided by pins 84 and 88 being disposed in housing slots 104 and 106, respectively. The pivoting and sliding movement of pawl support 86 will likewise cause pawl 94 to undergo similar movements, due to the rigid connection between them. Thus, as seen in FIGS. 5 and 5A, pawl 94 will be pivoted in a counterclockwise direction and out of contact with frame 14. Pawl 94 will then be slid leftwardly so as to be partially retracted within housing 62. In this position, sufficient clearance is available between pawl 94 and frame 14 whereby door 12 can be opened in the direction of arrow 108 in FIG. 5A.

To again latch the door 12 against the frame 14, handle 32 is pivoted in the clockwise direction (as seen in FIG. 2) which will cause a clockwise rotation of connecting rod 50. The clockwise rotation of rod 50 will, in turn, cause a clockwise rotation of crank 72 which, through links 80 and pins 82,84, will cause pawl support 84 and pin 88 to slide to the right. When pin 88 reaches the end of slot 106, pawl support 86 and pawl 94 will pivot in the clockwise direction and pawl 94 will engage frame 14 to pull door 12 tightly against the frame. Further rotation of crank 72 will cause pin 82 to pass the on-center position and the pawl will be secured by positive over-center latching action.

With reference now being made to FIGS. 9–19, the alternate embodiments for the actuator assembly of the present invention will be described.

Figure 11A:
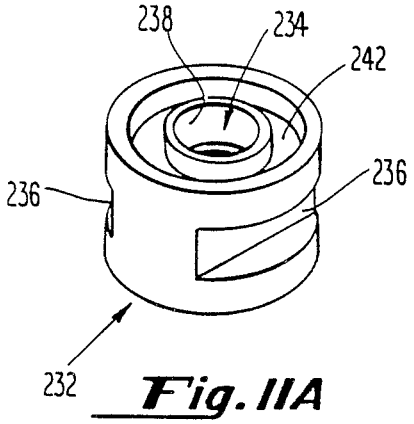
FIG. 11A is a perspective view of one actuator hub usable in the embodiments of FIGS. 9–16.
Figure 9:
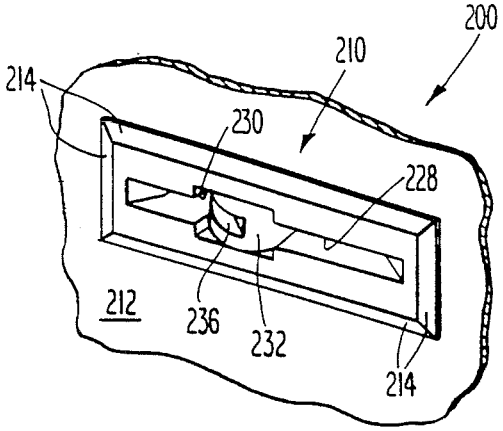
FIG. 9 is a perspective view of an alternate embodiment of the actuating assembly of the present invention, shown affixed to a panel.
Figure 12:
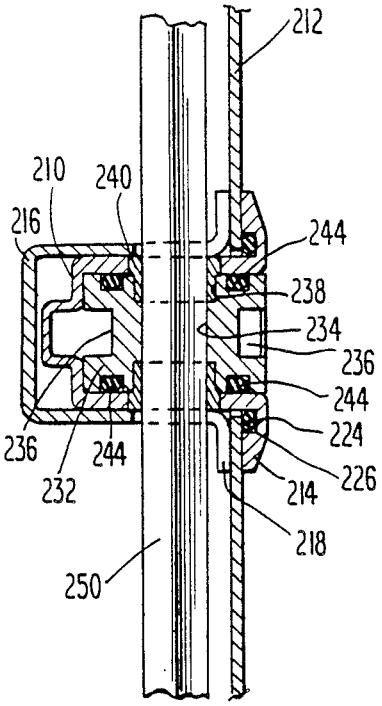
FIG. 12 is a sectional view of the actuator assembly, as seen along line 12—12 of FIG. 10.
Figure 10:
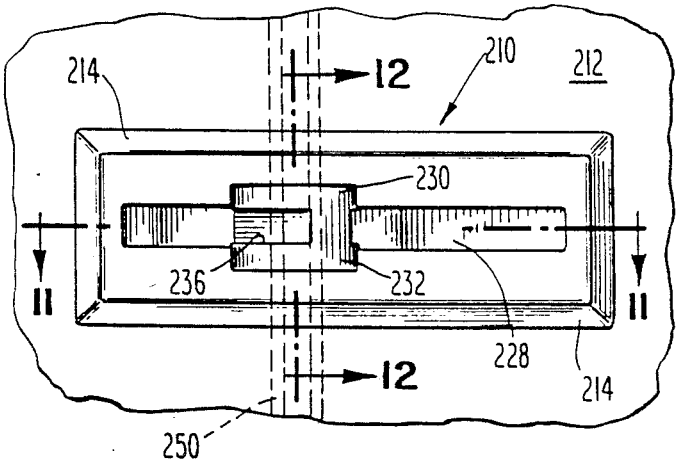
FIG. 10 is a front view of the embodiment of the actuator assembly of FIG. 9.
Figure 11:
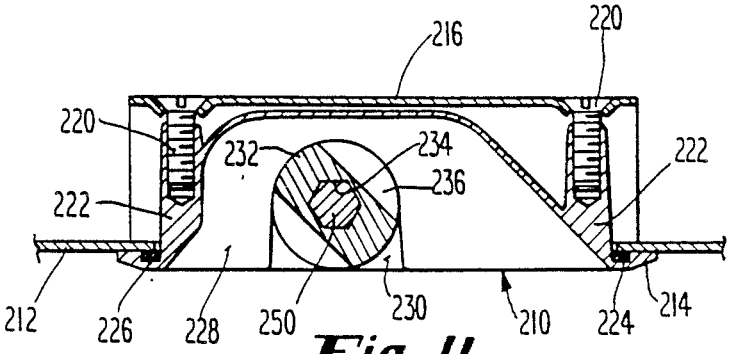
FIG. 11 is a sectional view of the actuator assembly, as seen along line 11—11 of FIG. 10.

As seen in FIGS. 9–12, actuator assembly 200 comprises a bath-tub shaped cup 210 which is adapted to be received within a aperture in a closure member, such as door 212. The front or face portion of cup 210 is provided with outwardly turned edges to form peripheral flange 214, which flange 214 facilitates the flush mounting of cup 210 to door 212, as seen in FIGS. 11–12. In this embodiment, cup 210 is held within the aperture in door 212 by bracket 216 which, as seen in FIGS. 11–13, is a substantially boxed shape member having outwardly turned longitudinal edges to form flange members 218, which give bracket 216 a U-shaped cross-sectional configuration.

As seen in FIGS. 11 and 12, bracket 216 is secured to cup 210 by a pair of screws 220, or other suitable fasteners, which traverse bracket 216 and are received within boss members 222 of cup 210. In this arrangement, door 212 is clamped between flanges 218 of bracket 216 and peripheral flange 214 of cup 210. In those instances in which it is desirable to seal the closure member against environmental factors, a ring seal 224 may be used, secured within a channel 226 on the underside of peripheral flange 214, as seen in FIGS. 11–12.

With reference to FIGS. 9–10, it can be seen that the face or front portion of cup 210 is provided with a narrow slot 228 disposed substantially along its width and extending rearwardly from the face of cup 210. Slot 228 is provided with an enlarged opening 230 into which is disposed actuator hub 232 in close-fit relation, as seen in FIGS. 10 and 12.

As seen in FIG. 11A, actuator hub 232 comprises a substantially cylindrical member having an internal bore 234 on its peripheral surface. The groove-like recesses 236 provide a configuration to hub 232 which can be engaged by a typical open-end or adjustable wrench to impart torque to hub 232. As seen in FIG. 11, bore 234 is provided with a polygonal surface configuration and is adapted to engage rod 250, which is also of polygonal cross-sectional configuration.

The ends of bore 234 are provided with annular stepped sections 238 which are of greater diameter than the polygonal-shaped segment of bore 234. Annular stepped sections 238 are adapted to receive therein bearing members 240 which form a pivotal connection between hub 232 and cup 210 and also facilitate the connection between actuator hub 232 and connecting member 250.

The ends of hub 232 are provided with an annular groove 242 disposed concentric to stepped section 238 of bore 234 (see FIG. 11A) into which is disposed an O-ring gasket 244 (see FIG. 12). O-rings 244 facilitate the connection between hub 232 and cup 210 and provide a tight seal against environmental factors.

With reference now being made to FIG. 13, illustrated therein is an embodiment of the actuator assembly just described in which the actuator hub 260 is provided with the tamper-resistant configuration illustrated in FIG. 13A. The tamper-resistant hub 260, as seen in FIG. 13A, is similar in construction to that previously described and illustrated in FIG. 11A and comprises a cylindrical member having an internal bore 262 and a pair of opposing recesses 264 on its peripheral surface which as seen in FIG. 13, are substantially triangle-shaped in cross-section. This shape of recesses 264 make it difficult for torque to be applied to hub 260 by conventional wrenches, screw drivers, pliers and other such tools and thus provide a tamper-resistant feature to the latching mechanism. As illustrated in phantom in FIG. 13, however, a specially shaped wrench 270 can be used to engage recess 264 and transmit torque, but that in all other respects, hub 260 is identical to hub 232, previously described, in terms of construction and function and that hubs 232 and 260 are completely interchangeable in any of the embodiments of the actuator assembly illustrated in FIGS. 9–16.

Another embodiment of the actuator assembly of the present invention is illustrated in FIGS. 14–16 which will now be described. In this embodiment, the actuator assembly comprises a cup 302 having a face portion 304 and a rearwardly extending narrow cavity 306 disposed longitudinally along cup 302. Face portion 304 is provided with a peripheral flange 308 to facilitate the flush mounting of cup 302 to a door or like closure member 310. A thickened section 312 of cavity 306 of cup 302 houses the actuator hub (either of 232 or 260) therein and is provided with apertures 314 to permit the passage of connecting means 250 therethrough.

Disposed on each surface of cup 302 which defines cavity 306 is a rib 316 which, in the embodiment shown, is formed integral with the thickened section 312.

As seen in FIGS. 14–16, cup 302 is adapted to be received within an aperture of door 310 and is retained therein by spring clip 318. Clip 318, as seen in FIG. 15, is a U-shaped member having a pair of legs 320 held in spaced relation to one another by cross-piece 322. With reference to FIGS. 14 and 16, it can be seen that legs 320 are of bent configuration so as to bias ribs 316 of cup 302 away from door 310 and thereby retain cup 302 in flush mounted relation to door 310. An angular tang 324 is provided on cross piece 322 to facilitate the insertion and removal of spring clip 318.

Figure 18:
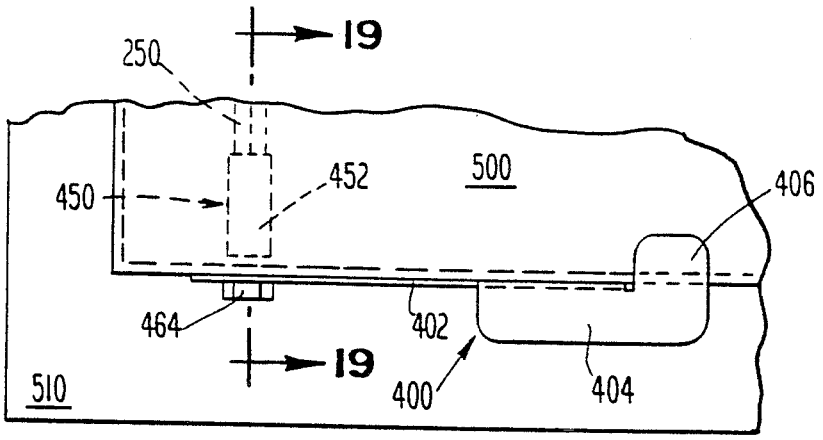
FIG. 18 is a front view of the lever-type embodiment of the actuator assembly, shown affixed to a closure member, with the connecting means being illustrated in phantom.
Figure 19:
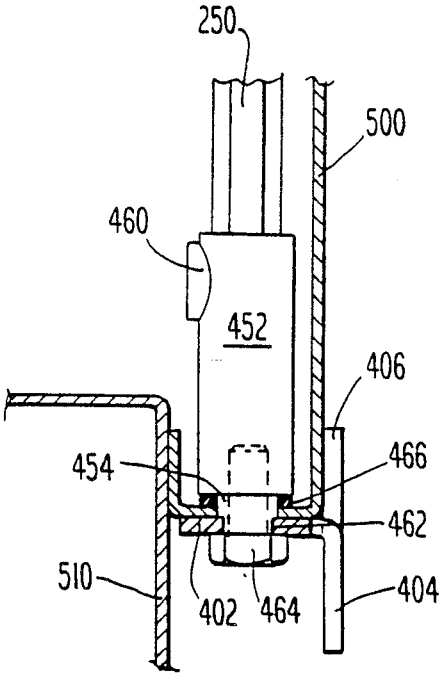
FIG. 19 is a sectional view of the lever-type actuator assembly as seen along line 19—19 of FIG. 18.
Figure 17:
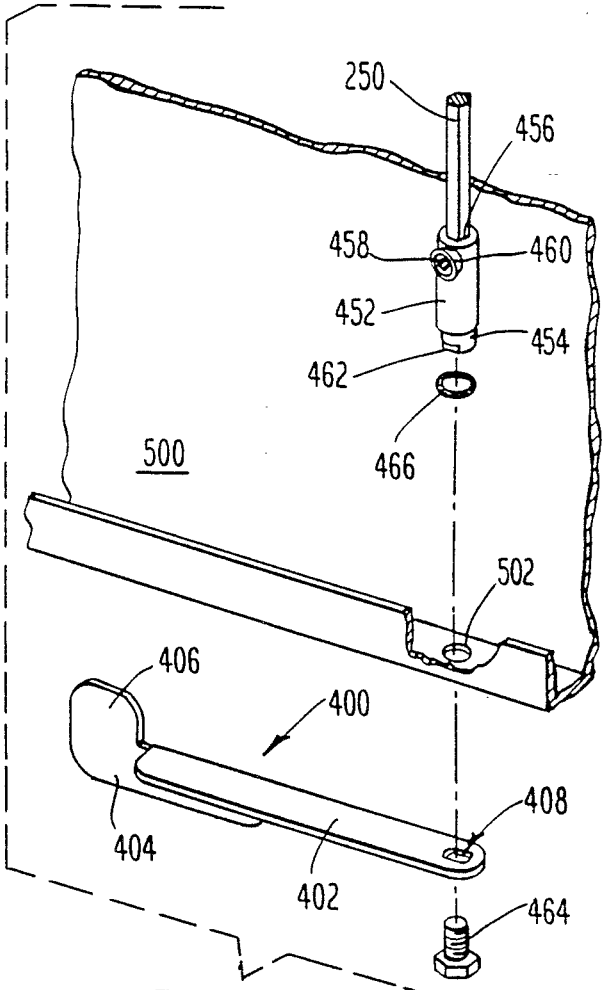
FIG. 17 is an exploded perspective view of the lever-type embodiment of the actuator assembly.

Another embodiment of the actuator assembly in accordance with the present invention is illustrated in FIGS. 17–19. In this embodiment, connecting rod 250 is rotated by means of a pivotal lever 400 acting on a socket-like member 450 which is affixed to rod 250. As best seen in FIG. 19, this embodiment is particularly suitable for use in cabinets and like enclosures in which the door 500 of the enclosure is maintained in spaced relation to the frame 510 of the enclosure when door 500 is in the closed position.

Lever 400, as seen in FIGS. 17–19, comprises an angular member having an elongate section 402 and a tab section 404 disposed substantially at a right angle to the elongate section. A stop member 406 extends upwardly from tab section 404 and is adapted to contact the door 500 and maintain the tab section 404 in substantially flush relation to door 500 and in spaced relation to frame 510.

Socket member 450, as seen in the FIGS., comprises an elongate, substantially cylindrical body portion 452 and a reduced diameter throat portion 454 connected to body portion 452. The end of body portion 452 remote from throat portion 454 is provided with an aperture 456 to receive therein connecting rod 250. To facilitate the transmission of torque from socket member 450 to rod 250, the configuration of aperture 456 is preferably the same as the cross sectional shape of the particular connecting rod 250 being used. In the preferred embodiment illustrated in the FIGS., the connection between rod 250 and body portion 452 of socket member 450 is further facilitated by a set screw 458 disposed within boss 460 on body portion 452.

As seen in FIGS. 17 and 19, throat portion 454 of socket member 450 is adapted to traverse door 500, and be received within aperture 408 of elongate portion 402 of lever 400. In the preferred embodiment shown in the FIGS., throat 454 is provided with notched recesses 462 to facilitate the connection between lever 400 and socket member 450 and thus, the transmission of torque to the socket member in response to the pivotal movement of the lever. As with aperture 456, aperture 408 is configured to match the cross-sectional configuration of throat portion 454. Lever 400 is attached to socket member 450 by bolt 464 or other suitable fastener. If desired, an O-ring seal 466 may be disposed about throat portion 454 to seal the cabinet from environmental contaminants.

Each of the embodiments of the actuator assembly illustrated in FIGS. 9–19 comprise means for rotating the connecting member about its longitudinal axis, which rotational motion actuates the latch assemblies in the manner described above. With respect to the embodiments illustrated in FIGS. 9–16, torque is applied to the actuator hub by means of a wrench-type tool of standard configuration or of the special configuration illustrated in FIG. 13, depending upon which embodiment of the actuator hub is used. The transmission of torque to the actuator hub in either instance causes the desired rotation of the connecting member to latch and unlatch the latch assemblies.

With respect to the embodiment illustrated in FIGS. 17–19, the fingers of the user are engaged with the rear surface of tab section 404 of lever 400. A simple pulling motion then causes the lever 400 to pivot which, in turn, rotates socket member 450 which, in turn, causes the desired rotation of the connecting rod to unlatch the latch assemblies and the door can be opened. To latch the door in the closed position one need only reverse the process just described and push lever 400 toward door 500 until stop member 406 contacts the door and prevents any further pivotal movement of lever 400.

The above description and the views depicted in the FIGS. are for purposes of illustration only and are not intended to be, and should not be construed as, limitations on the invention. In particular and without limitation, terms such as inside, outside, right, left, etc. and derivatives thereof have been used for purposes of clarity in describing the invention only and it is to be understood that particular orientations will depend upon the use of the invention in a particular circumstance. Moreover, certain modifications or alternatives may suggest themselves to those skilled in the art upon reading of this specification, all of which are intended to be within the spirit and scope of the present invention as defined in the appended claims.

What is claimed is:

1. A remote latching mechanism comprising:

a) a longitudinal connecting member rotatably movable about a longitudinal axis thereof;

b) actuator means for rotating said connecting member about its longitudinal axis;

c) a latch assembly operably connected to said connecting member for movement between latched and unlatched conditions in response to rotational movement of said connecting member;

d) wherein said actuator means comprises a rotatable actuator fixedly connected to said connecting member, whereby upon application of torque to said actuator, said connecting member is rotated about its longitudinal axis, wherein said actuator comprises a substantially cylindrical member having an aperture therein and wherein said connecting member is disposed within said aperture, said substantially cylindrical member having tool-engagable recesses on a peripheral surface thereof to facilitate the transmission of torque to said actuator; said actuator means further comprising a cup adapted for being inserted within an aperture in a closure member, and means for retaining said cup within an aperture in a closure member, wherein said actuator is pivotally connected to said cup, and wherein said means for retaining said cup within an aperture in a closure member comprises a spring clip.

2. A remote latching mechanism comprising:

a) a longitudinal connecting member rotatably movable about a longitudinal axis thereof;

b) at least one latch assembly operably connected to said connecting member for movement between latched and unlatched conditions in response to rotational movement of said connecting member;

c) actuator means for rotating said connecting member about its longitudinal axis;

d) said actuator means comprising:

1) a cup-like housing adapted for being inserted within an aperture in a panel;

2) means for retaining said housing within an aperture in a panel;

3) an actuator rotatably disposed within said housing and fixedly connected to said connecting member; and 4) bushing means connected to said housing, said connecting member and said actuator, said bushing means comprising mean for rotatably connecting said actuator to said housing.

3. The remote latching mechanism of claim 2, wherein said means for retaining said housing comprises a bracket.

4. The remote latching mechanism of claim 2, wherein said means for retaining said housing comprises a spring clip.

5. The remote latch mechanism of claim 2, wherein said housing further comprises flange means on a face portion thereof, said flange means comprises means for flush mounting said housing to a panel when said housing is inserted within an aperture in a panel.

6. The remote latching mechanism of claim 2, wherin said actuator comprises a substantially cylindrical member having a bore therthough, wherein said connecting member is disposed within said bore.

7. The remote latching mechanism of claim 6, wherein said substantially cylindrical member is provided with tool-engagable recesses on a peripheral surface thereof to facilitate the application of torque to said actuator.

8. The remote latching mechanism of claim 2, wherein said bushing means comprises a pair of bushing members disposed on opposing ends of said actuator and wherein said connecting member is disposed within said bushing members.

9. A remote latching mechanism comprising:

a) s longitudinal connecting member rotatably movable about a longitudinal axis thereof;

b) at least one latch assembly operably connected to said connecting member for movement between latched and unlatched conditions in response to rotational movement of said connecting member;

c) actuator means for rotating said connecting member about its longitudinal axis;

d) said actuator means comprising;

1) a housing adapted for being inserted in an aperture in a panel;

2) means for retaining said housing within an aperture in a panel;

3) an acutator pivotally connected to said housing for rotational movement therein and fixedly connected to said connecting member;

e) wherein said housing comprises a substantially enclosed, cup-shaped member having a longitudinally slot in a face thereof and rearwardly extending therefrom and wherein said actuator is disposed within said slot.

10. The remote latching mechanism of claim 9, wherein said actuator means further comprises bushing means connected to said actuator, said connecting member and said housing, said bushing means comprising means for rotatably mounting said actuator within said housing.

11. The remote latching mechanism of claim 9, wherein said retaining means comprises a bracket.

12. The remote latching mechanism of claim 9, wherein said retaining means comprises a spring clip.

13. The remote latching mechanism of claim 9, wherein said actuator comprises a substantially cylindrical member having tool-engagable recesses on a peripheral surface thereof to facilitate the application of torque to said actuator, and wherein said connecting member is disposed within a bore in said actuator.

14. The remote latching mechanism of claim 9, wherein said actuator means further comprises a pair of bushing members disposed on opposing ends of said actuator and connected to said housing and wherein said connecting member is disposed within said bushing members.

* * * * *

UNITED STATES PATENT AND TRADEMARK OFFICE

CERTIFICATE OF CORRECTION

PATENT NO. : 5,064,228

DATED : November 12, 1991

INVENTOR(S) : Robert H. Bisbing

It is certified that error appears in the above-identified patent and that said Letters Patent is hereby corrected as shown below:

Col. 4, line 68, "fanthom" should be --phantom--

Col. 6, line 54, after "is" insert --in--

Col. 11, line 17, "wherin" should be --wherein--

Col. 11, line 33, "s" should be --a--.

Col. 11, line 19, "therthough" should be --therethrough--.

Signed and Sealed this

Twentieth Day of April, 1993

*Attest:*

MICHAEL K. KIRK

*Attesting Officer*

*Acting Commissioner of Patents and Trademarks*